US007404298B2

(12) United States Patent
Kim et al.

(10) Patent No.: US 7,404,298 B2
(45) Date of Patent: Jul. 29, 2008

(54) REFRIGERATOR

(75) Inventors: Jung Ho Kim, Seoul (KR); Ik Kyu Lee, Changwon-si (KR); Ki Cheol Woo, Masan-si (KR)

(73) Assignee: LG Electronics Inc., Seoul (KR)

( * ) Notice: Subject to any disclaimer, the term of this patent is extended or adjusted under 35 U.S.C. 154(b) by 459 days.

(21) Appl. No.: 10/795,582

(22) Filed: Mar. 9, 2004

(65) Prior Publication Data

US 2004/0216471 A1 Nov. 4, 2004

(30) Foreign Application Priority Data

Mar. 10, 2003 (KR) ..... 10-2003-0014899
Mar. 10, 2003 (KR) ..... 10-2003-0014902
Mar. 10, 2003 (KR) ..... 10-2003-0014906

(51) Int. Cl.
*F25B 49/00* (2006.01)

(52) U.S. Cl. ..... 62/126; 62/246; 62/259.1; 62/298; 62/441; 248/27.1; 312/401; 312/402; 312/403; 312/404; 312/405; 312/405.1; 312/406; 361/676; 439/289; 439/929

(58) Field of Classification Search ..... 236/51; 62/126, 236, 231, 331, 246, 259.1, 298, 441; 439/289, 929; 361/676; 312/401, 402, 403, 312/404, 405, 405.1, 406; 248/27.1
See application file for complete search history.

(56) References Cited

U.S. PATENT DOCUMENTS 3,974,660 A * 8/1976 Farr ..... 62/229
5,883,820 A * 3/1999 Ota et al. ..... 361/683
5,992,155 A * 11/1999 Kobayashi et al. ..... 62/3.7
6,483,695 B1 * 11/2002 Hartstein ..... 361/680
7,047,039 B2 * 5/2006 Lalley ..... 455/556.2
2001/0053963 A1 * 12/2001 Kim et al. ..... 702/188
2003/0188206 A1 * 10/2003 Odaohhara ..... 713/300

FOREIGN PATENT DOCUMENTS

JP 2002039670 A * 2/2002

* cited by examiner

*Primary Examiner*—Cheryl J. Tyler
*Assistant Examiner*—Huseyin Koca
(74) *Attorney, Agent, or Firm*—Ked & Associates, LLP

(57) ABSTRACT

Refrigerator including a body forming an outer appearance of the refrigerator, a terminal detachably mounted on the body for controlling the refrigerator, a power supply device at one side of the body, for receiving power from an outside of the refrigerator, converting to a predetermined charge power, and supplying to the terminal, and an electric connection part connected between the power supply device and the terminal.

15 Claims, 5 Drawing Sheets

REFRIGERATOR

This application claims the benefit of the Korean Application Nos. P2003-14899, P2003-14902, and P2003-14906, three of which are filed on Mar. 10, 2003, which are hereby incorporated by reference.

BACKGROUND OF THE INVENTION

1. Field of the Invention

The present invention relates to refrigerators, and more particularly, to a refrigerator having a detachable terminal.

2. Background of the Related Art

In general, the refrigerator is used for long time fresh storage of food, and providing cold drinks, such as cold water, or ice to a user. The refrigerator is provided with a compressor as a part of a refrigerating cycle, for maintaining an inside of the refrigerator below a predetermined temperature.

In the meantime, recent refrigerator is controlled, not only manually by the user, but also electronically as the refrigerator is provided with devices that enable networking to receive information through the Internet, or a computer that enables the refrigerator to be operated by a main controller of a home network system.

Moreover, a display screen of the terminal having a computer built therein is provided to an exterior of the refrigerator, so that the user can provide an order required for operation of the refrigerator in a touch screen like fashion.

FIG. 1 illustrates a perspective view of a related art refrigerator.

Referring to FIG. 1, the refrigerator 1 is provided with a refrigerator terminal 2 attached to a front of a door. The terminal 2 is connected to an external power source, for receiving power.

The terminal 2 has a display part 3 for displaying operation information of the refrigerator, so that the user can check an operation state of the refrigerator, or provide an operational order thereto in a touch screen fashion.

In the meantime, the terminal has a power supply device built therein, provided with an AC adapter, a charge regulator for receiving power from the AC adapter and supplying a preset magnitude of power, and a microcomputer for controlling the charge regulator.

However, the refrigerator having the refrigerator terminal attached thereto has the following problems.

First, as described, the related art power supply device, in general, built-in the refrigerator terminal 2 attached to one side of the front of the refrigerator 1 door, increases a volume and weight of the refrigerator terminal, to impedes fabrication of a small sized and light weighted refrigerator terminal.

Second, the direct supply of the external power to the related art power supply device is liable to cause damage thereto by a high voltage.

Third, the mounting of the related art refrigerator terminal to face only one direction without protection leaves the display screen 3 susceptible to damage from external foreign matters, or children who do not know operation.

SUMMARY OF THE INVENTION

Accordingly, the present invention is directed to a refrigerator that substantially obviates one or more of the problems due to limitations and disadvantages of the related art.

An object of the present invention is to provide a refrigerator which has a small sized and light weighted terminal, and small size.

Other object of the present invention is to provide a refrigerator, in which a power supply device and a terminal are electrically connected to each other even if the terminal is inserted in a wrong direction, for preventing defective connection caused by a wrong direction mounting of the terminal.

Another object of the present invention is to provide a refrigerator, in which a terminal can be mounted with a front face thereof faced to a rear side, for preventing damage or wrong operation of the terminal by a person who do not know operation.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the refrigerator includes a body forming an outer appearance of the refrigerator, a terminal detachably mounted on the body for controlling the refrigerator, a power supply device at one side of the body, for receiving power from an outside of the refrigerator, converting to a predetermined charge power, and supplying to the terminal, and an electric connection part connected between the power supply device and the terminal.

The body includes a case openably mounted for detachably receiving the terminal, and a case hollow for inserting the case therein, and joining the case therewith.

The case includes an opened upper part for inserting the detachable terminal into the case therethrough, a front part having a window for exposing a front face of the terminal, a bottom part for supporting a bottom of the terminal, side parts for supporting and guiding opposite side surfaces of the terminal, and a rear part for supporting a rear surface of the terminal.

The side parts of the case are formed lower than opposite side parts of the terminal for easy insertion, and drawing out of the terminal.

The rear part of the case is formed lower than a rear part of the terminal for easy insertion, and drawing out of the terminal.

The body further includes a rotation device connected between the case and the case hollow for opening/closing as the case is rotated.

The rotation device includes hinges provided to side surfaces of the case and opposite side surfaces of the hollow.

The hinge includes a projection from each of opposite side surfaces of a lower part of the case as a rotation axis of the case, and a hole in each of opposite side surfaces of the hollow in correspondence to the projection.

The power supply device includes an AC adapter for receiving the external power, a charge regulator for receiving a power from the AC adapter, and supplying a preset charge power, and a microcomputer for controlling the charge regulator, to regulate the charge power supplied to the terminal through the electric connection part.

The electric connection part includes a contact terminal part for electrically connecting the charge battery in the terminal, and the power supply device, and electric wiring for electrically connecting the contact terminal part and the power supply device.

The contact terminal part includes a first contact terminal at one side of the terminal for electrical connection to the charge battery, and a second contact terminal at the case to face the first contact terminal when the terminal is mounted in the case.

The contact terminal part includes a first contact terminal at one side of the terminal for electrical connection to the charge battery, a second contact terminal at the case to face the first contact terminal when the terminal is mounted in the case such that a front face of the terminal faces the front, and a supplementary contact terminal at the case to face the first contact terminal when the terminal is mounted in the case such that a front face of the terminal faces the rear.

The first contact terminal is fitted at one side part of an underside of the terminal.

The second contact terminal and the supplementary contact terminal are fitted to a bottom of the case in symmetry to each other.

The second contact terminal and the supplementary contact terminal are fitted so as to be projected toward the terminal.

The terminal includes a terminal recess in an underside thereof symmetry to the first contact terminal, for receiving the second contact terminal or the supplementary contact terminal to prevent the terminal from tilting, or the second contact terminal or the supplementary contact terminal suffering from damage.

The terminal is detachably mounted on a door which forms a front face of the body.

The terminal receives an order in a touch screen fashion.

Thus, the present invention permits to make the refrigerator terminal to be small and light weighted, and to prevent the terminal from being operated wrongly or suffering from damage by a person who is unable to operate by changing a mounting direction of the terminal as required.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

To help understanding the present invention, functions of a refrigerator will be described.

The refrigerator is an appliance configured to perform a cold storage function in which food or drink are stored and conserved in a fresh state, an ice making function in which water is frozen to provide the water in an ice state, and a freezing function in which food is frozen to conserve the food in a frozen state.

For this, the refrigerator has a compressor, heat exchangers, and the like of a refrigerating cycle, and a refrigerating chamber and a freezing chamber inside of a body of the refrigerator formed to appropriate sizes according to a purpose of use.

An inside space having the refrigerating chamber and the freezing chamber therein is closed with a door on a front of the refrigerator body, and the door has a terminal having a microcomputer built therein mounted on a front surface for controlling the refrigerator. The terminal enables the refrigerator to receive information from Internet through a network, or to be controlled by a main controller of a home network system electronically, to display information for the user, or to receive a user's operation order.

Figure 1:
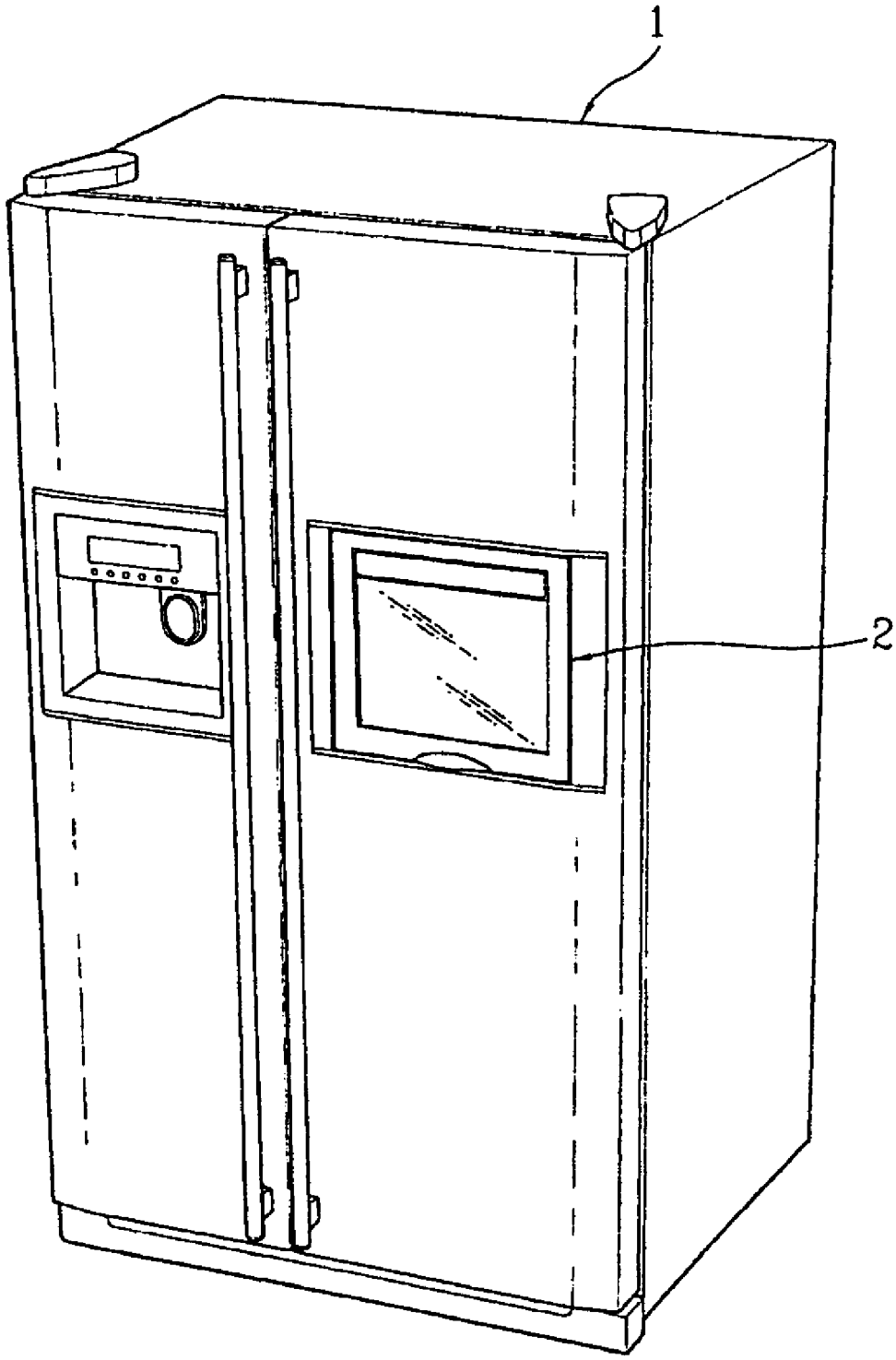
FIG. 1 illustrates a perspective view of a related art refrigerator.
Figure 2:
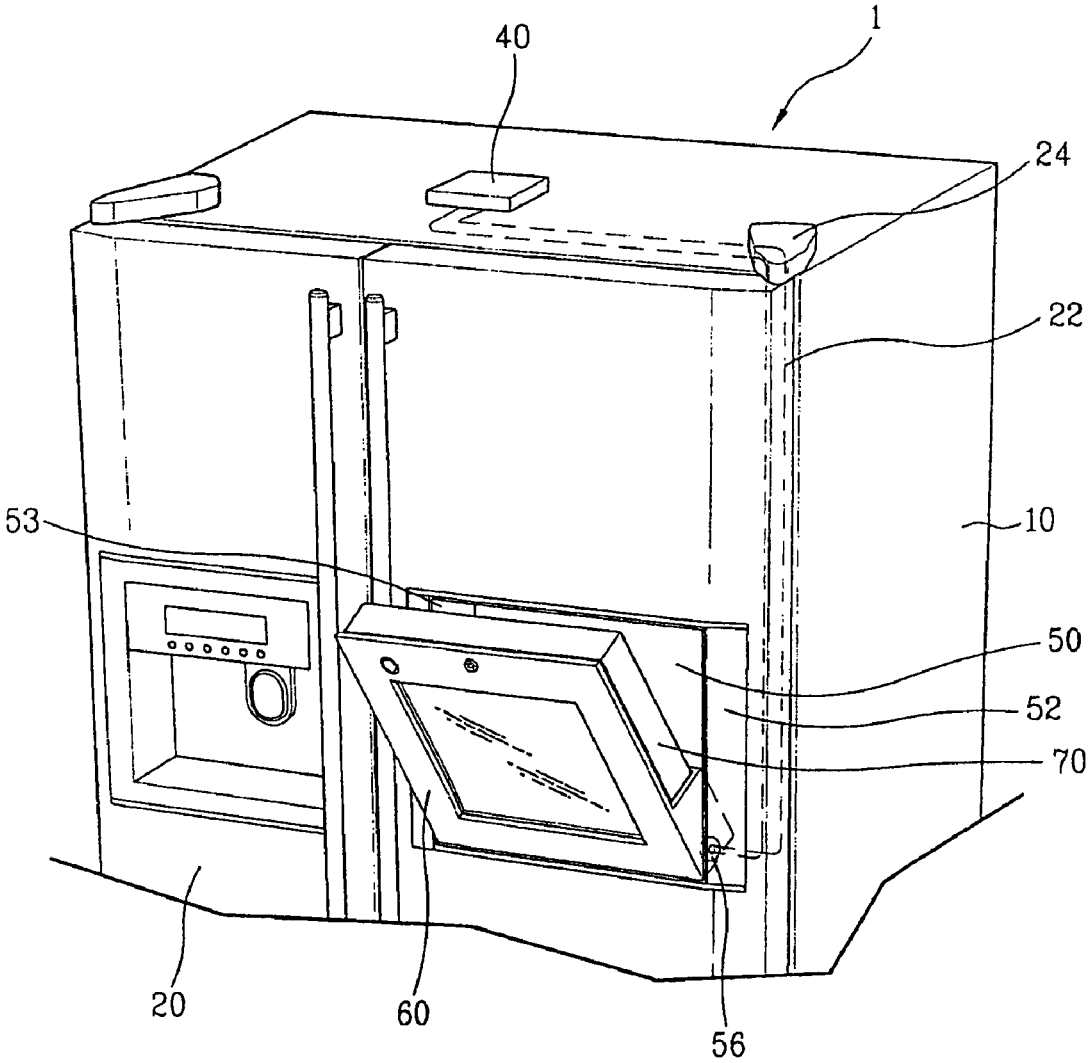
FIG. 2 illustrates a perspective view of a refrigerator in accordance with a preferred embodiment of the present invention having a detachable terminal provided thereto.

The refrigerator of the present invention will be described with reference to FIGS. 2~5. FIG. 2 illustrates a perspective view of a refrigerator in accordance with a preferred embodiment of the present invention having a detachable terminal provided thereto.

Referring to FIG. 2, the refrigerator 1 of the present invention includes a body 10 forming an outer appearance of the refrigerator, a power supply device 40 at one side of the body, a terminal 70 provided to the body, and an electric connection part connected between the power supply device 40 and the terminal 70.

The refrigerator body 10 has a refrigerating chamber (not shown), and a freezing chamber (not shown) for holding food therein, to be opened/closed by doors 20 forming front surface of the body.

The door 20 has a hollow 50 having a predetermined size of space formed inside of the front surface of the door 20, and a case 60 mounted in the hollow 50 rotatably connected to opposite side walls 52, and 53 of the hollow 50. The case 60 has the terminal 70 detachably mounted thereon.

Figure 3:
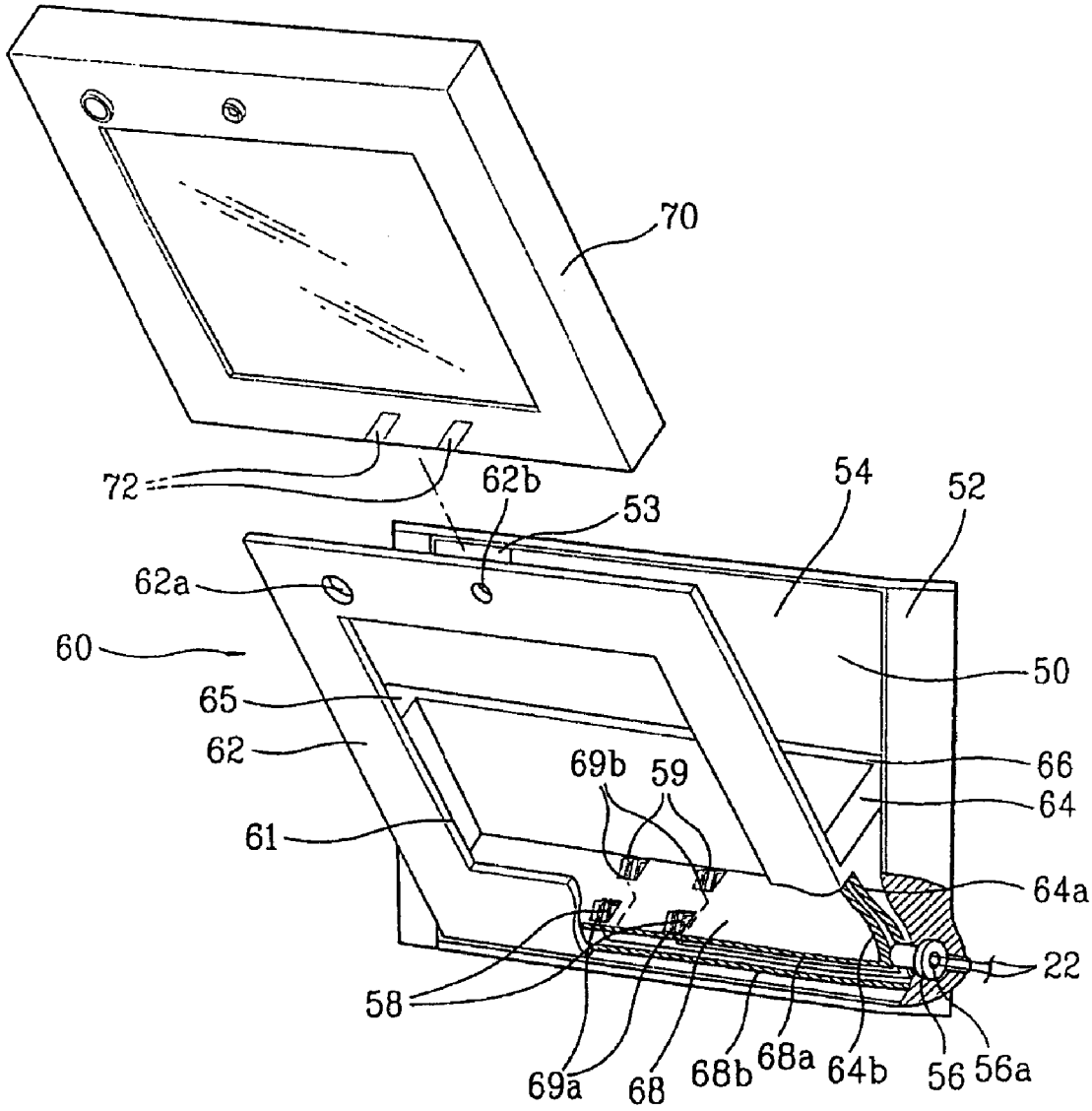
FIG. 3 illustrates a perspective view showing a state in which a terminal provided to a refrigerator of the present invention is separated from a case for mounting the terminal thereon.
Figure 4:
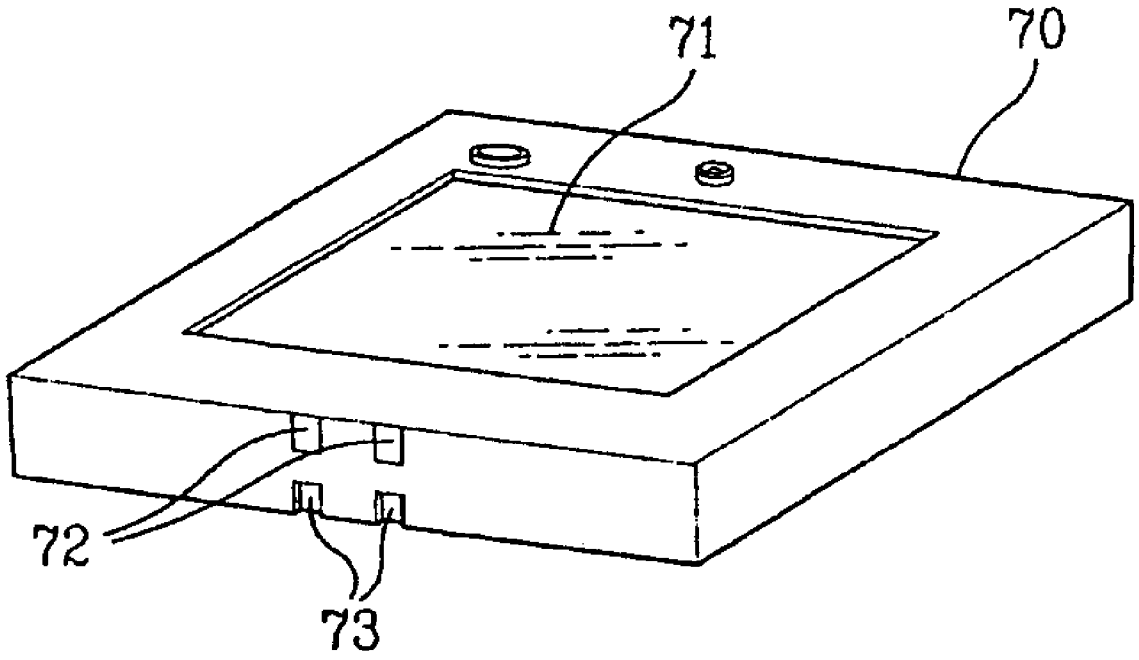
FIG. 4 illustrates a perspective view of a terminal to be provided to a refrigerator of the present invention.

Referring to FIG. 3, the case 60 includes an opened upper part (not shown) for inserting/drawing the detachable terminal 70 in/out of the case 60 therethrough, a front part 62 having a window 61 for exposing a display screen 71 which is a front face of the terminal 70, side parts 64, and 65 for supporting and guiding opposite side surfaces of the terminal, and facing opposite side walls 52, and 53 of the hollow 50, a rear part 66 for supporting a rear surface of the terminal 70, and a bottom part 68 for supporting a bottom of the terminal.

Since the case 60 has the detachable terminal 70 inserted in, or removed from an inside space formed by the front part 62, the side parts 64, and 65, the rear part 66, and the front part 68, the case 60 has a size suitable for receiving the terminal 70.

In more detail, the inside space of the case is formed almost the same with, or greater than a size of the detachable terminal 70. However, it is preferable that, for connection of contact terminals described later, the case 60 has a minimum size required for smooth insertion into, and drawing out of the terminal 70, such that the terminal hardly move in a state mounted in the case.

The front part 62 of the case may have a microphone opening 62*a* and a camera opening 62*b* additionally for exposing a microphone (not shown) and a camera (not shown) provided to the terminal 70.

Additionally, the front part 62 of the case may have a hand grip (not shown) for opening/closing the case 60.

The side parts 64, and 65 of the case 60, joined to the opposite side walls 52, and 53 of the hollow 50 with rotatable devices, such as hinges 56, enable the case 60 to be opened/closed as the side parts 64, and 65 are rotated. In more detail, each of the hinges 56, formed at opposite side surfaces of a lower part of the case, or opposite side walls of a lower part of the hollow respectively, may have a projection (not shown) as a rotation axis of the case, and a hole (not shown) formed in the other side of the projection.

Though not shown, it can be noted that the rotation device may be a hinge between the bottom 68 of the case 60 and the bottom 55 of the hollow 50. It is preferable that the case 60 can be opened only at a predetermined angle by means of a related art configuration.

In the meantime, it is preferable that the side parts 64, and 65 of the case are formed lower than the opposite side surfaces of the detachable terminal 70, so that the user can remove the detachable terminal 70 from the opened case 60, easily.

It is also preferable that the rear part 66 of the case 60 is formed lower than the rear part of the terminal 70, so that the user inserts, draws out the terminal 70, easily.

That is, at least one of the side parts 64, and 65 or the rear part of the case is formed lower than the detachable terminal 70.

Referring to FIGS. 2~5, the power supply device 40 is mounted on one side of the refrigerator body 10, more specifically, on a top part of the body, separate from the terminal 70.

Figure 5:
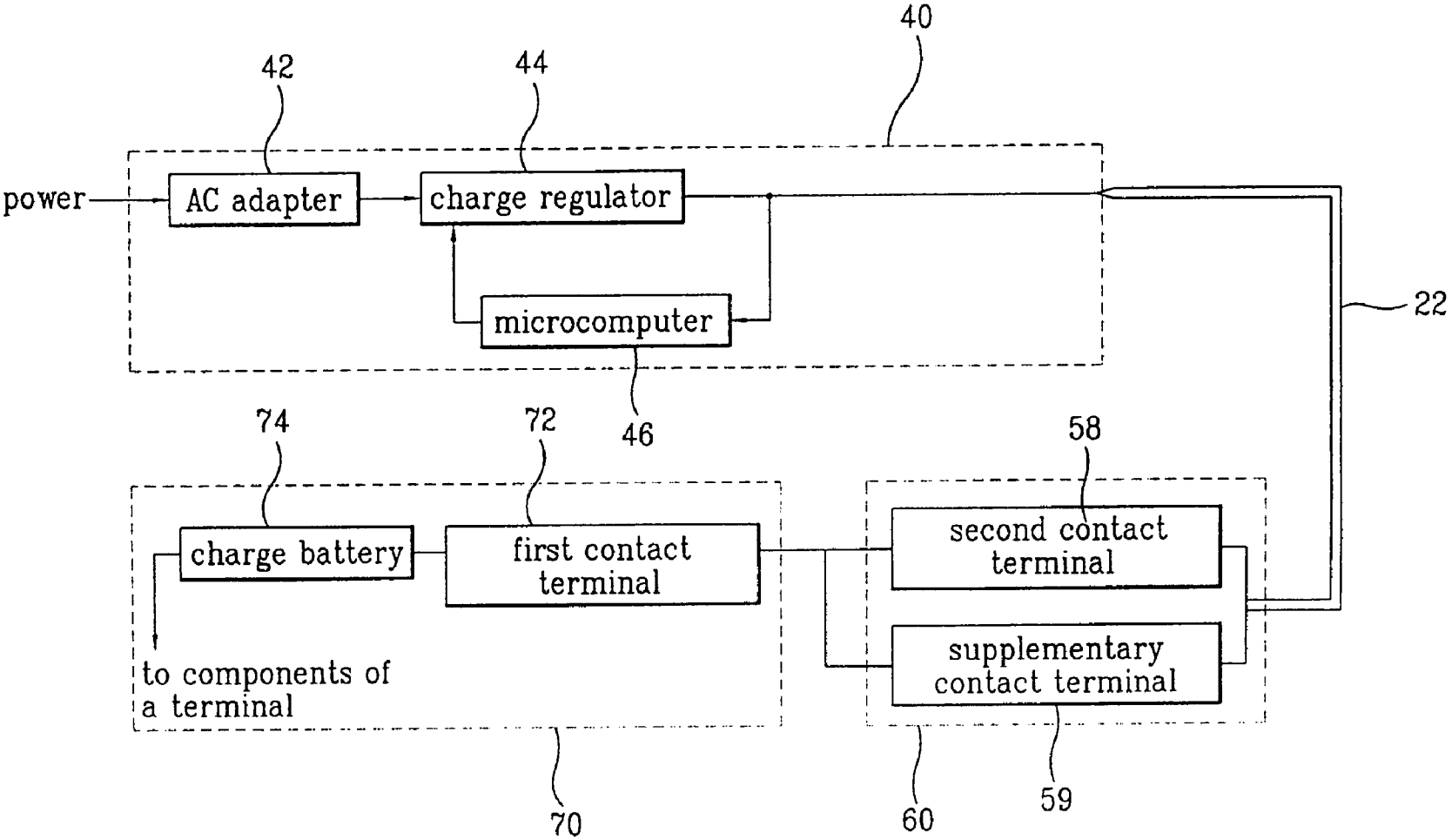
FIG. 5 illustrates a block diagram showing a system of a terminal provided to a refrigerator of the present invention, a power supply device, and an electric connection part connected between the terminal and the power supply device.

Referring to FIG. 5, an external power is supplied to a charge battery 74 through the electric connection part by the power supply device 40.

The power supply device 40 includes an AC adapter 42 for receiving the external power, a charge regulator 44 for receiving a power from the AC adapter 42, and supplying a preset magnitude of charge power, and a microcomputer 46 for controlling the charge regulator 44, to regulate the charge power.

The electric connection part includes a first contact terminal 72 at one side of the terminal 70 for electric connection to the charge battery 74 inside of the detachable terminal 70, a second contact terminal 58 on an underside of the case to opposite to the first contact terminal when the terminal 70 is mounted in the case, and an electric wiring 22 electrically connected between the second contact terminal 58, and the power supply device 40.

It is preferable that, even if a mounting direction of the terminal 70 is changed, for an example, the terminal 70 is mounted with the display screen 71 faced to a rear side, the second contact terminal 58 is able to be connected to the first contact terminal 72. For this, the first contact terminal 72 may be arranged at a center of the underside of the terminal 70, and the second contact terminal 58 may be also arranged at a center of the bottom 68 of the case.

Different from this, the first contact terminal 72 is arranged on one side part of the underside of the terminal, particularly, a front side part, and the second contact terminal 58 is arranged on a front side part of the bottom 68 of the case, so that the second contact terminal 58 is brought into contact with the first contact terminal only when the terminal is mounted in the case, with the display screen 71 faced a front. In this instance for facing the first contact terminal 72 when the terminal is mounted in the case, with the display screen 71 faced a rear, a supplementary contact terminal 59 is provided on the bottom of the case, additionally. In more detail, the second contact terminal and the supplementary contact terminal are arranged symmetry to each other.

It is preferable that at least one of the first contact terminal 72 on the terminal 70 and the second contact terminal on the case is projected, for preventing defective contact between the terminals 72, and 58 to receive power smoothly when the detachable terminal 70 is inserted into the case 60.

In the embodiment, the second contact terminal 58 is projected, and in correspondence to this, the supplementary contact terminal 59 is also projected.

Of course, the contact terminals may be arranged at positions other than the bottom of the case 60 and the underside of the detachable terminal 70.

It is preferable that the detachable terminal 70 has terminal recesses 73 in the underside thereof at positions facing the first contact terminal 58.

The terminal recess 73 receives the supplementary contact terminal, or the second contact terminal when the detachable terminal 70 is inserted in the case, to prevent the terminal from tilting, as well as the supplementary terminal or the second contact terminal suffering from damage.

The first contact terminal 72, the second contact terminal 58, and the supplementary contact terminal 59 form a contact terminal part of the electric connection part. In the present invention, the contact terminal part is configured such that the charge battery 74 of the terminal can maintain an electric connection to the power supply device 40 even a case the mounting direction of the terminal is changed, particularly, the terminal is mounted in the case with the display screen faced a rear. However, it can be noted that the configuration of the contact terminal part is not limited to above, but there can be a variety of configuration. That is, opposite to the configuration of the present invention, the supplementary contact terminal is arranged on the terminal so as to be connected to the computer, and the terminal recess is arranged in the bottom of the case.

Next, for applying a voltage from the power supply device 40 to the contact terminal part, the electric wiring 22 has one end connected to the power supply device 40, and the other end connected to the second contact terminal and the supplementary terminal. The electric wiring 22 is laid along an upper wall, a door hinge part 24, and an inside of the door 20.

The electric wiring passed through the inside of the door 20 is connected to the second contact terminal, and the supplementary terminal through the case 60.

For this, a side part 64 of the case has a double structure with an outer wall 64*a* and an inner wall 64*b* to form a space in the middle, and the outer wall 64*a* has pass through holes (not shown) for pass of the electric wiring. The structure of the side part 64, configured for securing a passage of the electric wiring 22, may be a size of guide groove, such as a narrow passage, for guiding the electric wiring.

The bottom part 68 of the case also has a double stricture with an upper wall 68*a* and a lower wall 68*b* to form a space between the walls. In this instance, the upper wall 68*a* of the bottom part 68 has openings 69*a* and 69*b* at positions symmetry to each other for fitting the second contact terminal 58, and the supplementary contact terminal 59 therein. The structure of the bottom part 68 of the case, also configured to secure a passage of the electric wiring 22, may be a size of guide groove, such as a narrow passage, for guiding the electric wiring.

Moreover, for connection of the electric wiring 22 to the contact terminals 58, and 59, the hinge 56 has a coaxial hole 56*a*, so that the electric wiring 22 passed through the inside of the door 20 is connected to the second contact terminal 58 and the supplementary contact terminal 59 after passing through the coaxial hole 56*a* in the hinge, inside spaces of the side part 64 and the bottom part 68 of the case 60.

Different from above, if the bottom part 68 of the case 60, and a bottom part 55 of the hollow 50 are joined with hinge, for opening or closing the case 60, a pass through hole is formed in a rotation shaft of the hinge for passing the electric wiring 22, so that the electric wiring 22 is connected to the second contact terminal 58 and the supplementary contact terminal 59 through the bottom part of the case.

The electric wiring may be laid in a variety of forms by known arts.

Above configuration enables the power supply device 40 that receives an external power to supply charge power to the charge battery in the terminal through the electric wiring 22.

In more detail, if the terminal is mounted such that the display screen 71 thereof faces the front, the charge power is supplied from the power supply device to the charge battery of the terminal through the electric wiring 22, the second contact terminal 58, and the first contact terminal 72, and if the terminal is mounted such that the display screen 71 thereof faces the rear, the charge power is supplied from the power supply device to the charge battery of the terminal through the electric wiring 22, the supplementary contact terminal, and the first contact terminal 72.

Then, the charge battery 74 stores the charge power, and supplies to components (not shown) of the detachable terminal 70 of respective refrigerators as necessary.

Moreover, for preventing the terminal 70 from being operated wrongly, or damaged by a person who do not know operation, such as a child, when the user is out, the terminal is mounted in the case such that the display screen 71 faces the rear, i.e., not to be exposed to an outside of the refrigerator, and, when the user intends to look at operation information of the refrigerator or to input an operation order, the terminal is mounted in the case such that the display screen 71 faces the front, for looking at the operation information of the refrigerator, or inputting the operation order by a touch screen fashion.

As has been described, the refrigerator of the present invention has the following advantages.

First, the separation of the power supply device from the terminal permits to make the terminal small and light, thereby reducing an entire volume of the refrigerator.

Second, the provision of the contact terminal part in the electric connection part that enables to connect the power supply device to the terminal even if the mounting direction of the terminal is changed prevents the terminal from being mounted wrongly.

Third, the provision of the terminal recesses for receiving the contact terminals prevents damage to the contact terminals when the terminal is mounted wrongly, as well as tilting of the terminal.

Fourth, because the terminal can be mounted on the body such that a front face of the terminal faces a rear side, damage to the terminal or wrong operation by a person who do not know operation of the refrigerator can be prevented.

Fifth, the formation of the side parts and rear part of the case that receives the terminal lower than the terminal permits easy insertion and drawing out of the terminal.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A refrigerator, comprising:

a body forming an outer appearance of the refrigerator;

a terminal detachably mounted on the body configured to control the refrigerator;

wherein the body includes:

a case openly mounted on the body configured to detachably receive the terminal therein;

a case hollow configured to receive the case therein, and join the case thereto;

wherein the case includes:

an opened part configured to receive the terminal therethrough;

a front part having a window for exposing a front face of the terminal;

a bottom part for supporting a bottom of the terminal;

side parts configured to support and guide opposite side surfaces of the terminal; and a rear part configured to receive a rear surface of the terminal;

a power supply device mounted on or in the body configured to receive power from outside of the refrigerator, convert it to a predetermined charge power, and supply it to the terminal;

an electric connection part connected between the power supply device and the terminal by a direct contact form when the terminal is detachably mounted on the body;

wherein the electric connection part includes:

a contact terminal part configured to electrically connect a charge battery in the terminal and the power supply device; and electric wiring configured to electrically connect a contact terminal part of the terminal and the power supply device;

wherein the contact terminal part comprises:

a first contact terminal at one side of the terminal configured for electrical connection to the charge battery; and a second contact terminal in the case configured to face the first contact terminal when the terminal is mounted in the case.

2. The refrigerator as claimed in claim 1, wherein the side parts of the case are configured to be disposed lower than opposite side parts of the terminal for easy insertion, into and drawing out of the terminal from the case.

3. The refrigerator as claimed in claim 1, wherein the rear part of the case is configured to be disposed lower than a rear part of the terminal for easy insertion and drawing out of the terminal from the case.

4. The refrigerator as claimed in claim 1, wherein the body further includes a rotation device connected between the case and the case hollow configured to open/close as the case is rotated.

5. The refrigerator as claimed in claim 4, wherein the rotation device includes hinges provided to side surfaces of the case and opposite side surfaces of the hollows.

6. The refrigerator as claimed in claim 5, wherein the hinge includes:

a projection from each of opposite side surfaces of a lower part of the case which functions as a rotation axis of the case; and a hole in each of opposite side surfaces of the hollow corresponding to the projection.

7. The refrigerator as claimed in claim 1, wherein the power supply device includes:

an AC adapter configured to receive power;

a charge regulator configured to receive power from the AC adapter and supply a preset charge power; and a microcomputer configured to control the charge regulator and regulate the charge power supplied to the terminal through the electric connection part.

8. The refrigerator as claimed in claim 1, wherein the second contact terminal in the case is configured to face the first contact terminal when the terminal is mounted in the case such that a front face of the terminal faces the front, wherein the contact terminal part further includes a supplementary contact terminal in the case configured to face the first contact terminal when the terminal is mounted in the case such that a front face of the terminal faces the rear.

9. The refrigerator as claimed in claim 8, wherein the first contact terminal is fitted at one side of an underside of the terminal.

10. The refrigerator as claimed in claim 9, wherein the second contact terminal and the supplementary contact terminal are fitted to a bottom of the case in symmetry to each other.

11. The refrigerator as claimed in claim 10, wherein the second contact terminal and the supplementary contact terminal are fitted so as to be projected toward the terminal.

12. The refrigerator as claimed in claim 11, wherein the terminal includes a terminal recess in an underside thereof in symmetry to the first contact terminal, configured to receive the second contact terminal or the supplementary contact terminal to prevent the terminal from tilting, or the second contact terminal or the supplementary contact terminal from suffering damage.

13. The refrigerator as claimed in claim 1, wherein the terminal is detachably mounted on a door which forms a front face of the body.

14. The refrigerator as claimed in claim 13, wherein the terminal includes a display screen configured to display operation information of the refrigerator on a front fact thereof.

15. The refrigerator as claimed in claim 14, wherein the terminal receives an order in a touch screen fashion.

* * * * *